US008385773B2

(12) United States Patent
Awano

(10) Patent No.: US 8,385,773 B2
(45) Date of Patent: Feb. 26, 2013

(54) MOUNTING STRUCTURE OF REMOVABLE MEMBER, AND IMAGE FORMING APPARATUS

(75) Inventor: Toyohiko Awano, Kanagawa (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 308 days.

(21) Appl. No.: 12/909,652

(22) Filed: Oct. 21, 2010

(65) Prior Publication Data

US 2011/0262188 A1 Oct. 27, 2011

(30) Foreign Application Priority Data

Apr. 23, 2010 (JP) ..... 2010-100124

(51) Int. Cl.
*G03G 15/00* (2006.01)
*G03G 15/08* (2006.01)

(52) U.S. Cl. ..... 399/110; 399/258; 399/263

(58) Field of Classification Search ..... 399/25, 399/27, 110, 258, 262, 263, 111
See application file for complete search history.

(56) References Cited

U.S. PATENT DOCUMENTS 5,512,984 A 4/1996 Kimura et al.
5,842,093 A * 11/1998 Tanda ..... 399/263
2006/0153590 A1* 7/2006 Igarashi ..... 399/116

FOREIGN PATENT DOCUMENTS

JP 8-305103 A 11/1996

* cited by examiner

*Primary Examiner* — Sandra Brase
(74) *Attorney, Agent, or Firm* — Sughrue Mion, PLLC

(57) ABSTRACT

A mounting structure of a removable member includes a body; a removable member mounted to and dismounted from the body; a functional member provided at the removable member and having a determined function; a first gear provided at the removable member and transmitting power to the functional member; a second gear provided at the body, and engaging the first gear and transmitting the power to the first gear when the removable member is mounted to the body; and a covering member provided at the body. The covering member moves to an engageable position where the first and second gears are engageable with each other when the removable member is mounted to the body. The covering member covers at least a portion of the second gear from an engagement side of the first gear by moving from the engageable position when the removable member is dismounted from the body.

6 Claims, 14 Drawing Sheets

MOUNTING STRUCTURE OF REMOVABLE MEMBER, AND IMAGE FORMING APPARATUS

CROSS-REFERENCE TO RELATED APPLICATIONS

This application is based on and claims priority under 35 USC 119 from Japanese Patent Application No. 2010-100124 filed Apr. 23, 2010.

BACKGROUND

(i) Technical Field

The present invention relates to a mounting structure of a removable member, and an image forming apparatus.

SUMMARY

According to an aspect of the invention, there is provided a mounting structure of a removable member including a body; a removable member that is mounted to and dismounted from the body; a functional member provided at the removable member and having a determined function; a first gear provided at the removable member and transmitting power to the functional member; a second gear provided at the body, and engaging the first gear and transmitting the power to the first gear when the removable member is mounted to the body; and a covering member provided at the body. The covering member moves to an engageable position where the first gear and the second gear are engageable with each other when the removable member is mounted to the body. The covering member covers at least a portion of the second gear from an engagement side of the first gear by moving from the engageable position when the removable member is dismounted from the body.

BRIEF DESCRIPTION OF THE DRAWINGS

Exemplary embodiments of the present invention will be described in detail based on the following figures, wherein.

DETAILED DESCRIPTION

A mounting structure of a removable member according to an exemplary embodiment will be described with reference to FIGS. 1A to 14. An arrow UP shown in the figures indicates a vertically upward direction.

Figure 14:
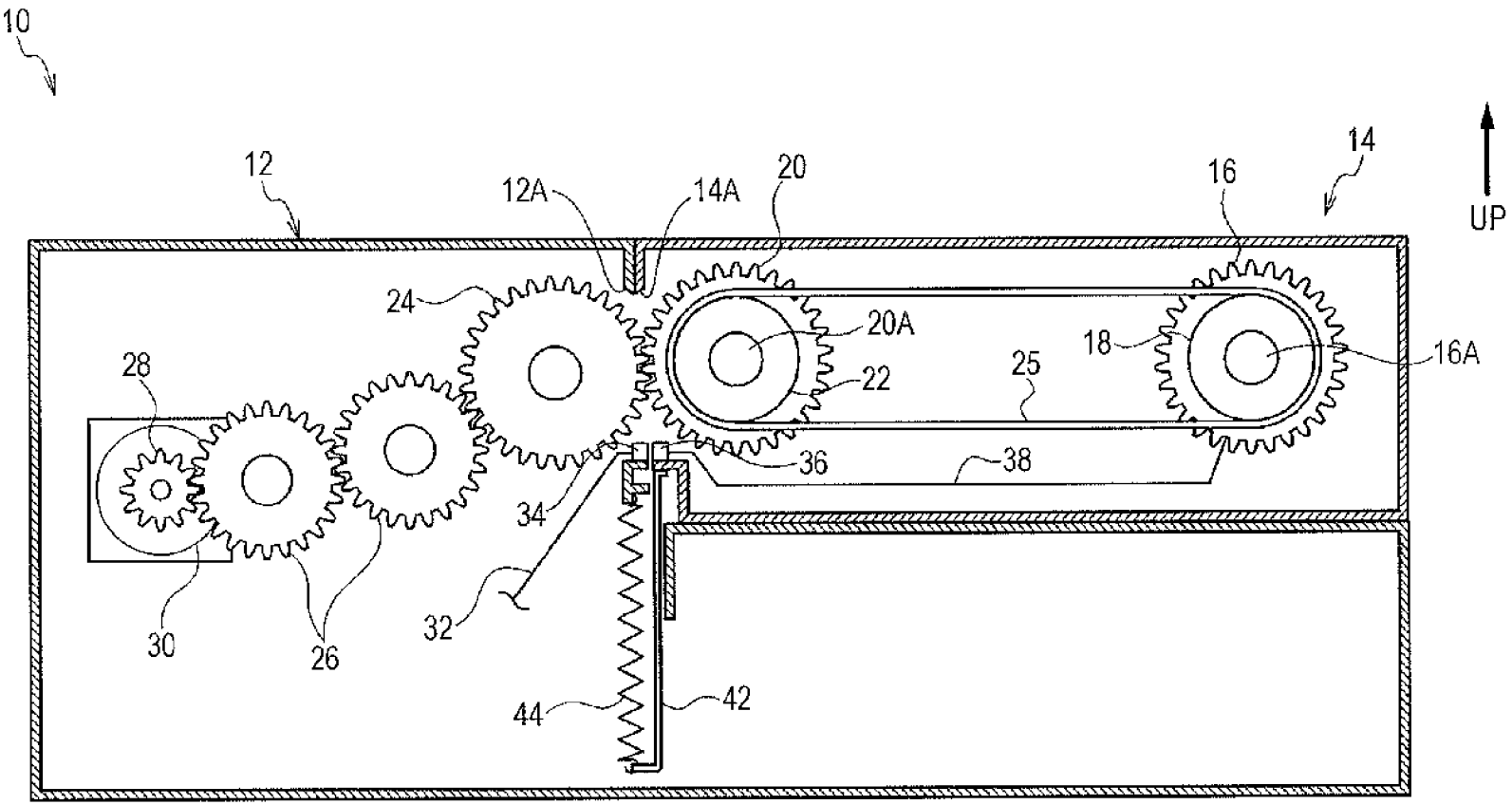
FIG. 14 is a schematic structural view of an apparatus according to an exemplary embodiment of the present invention.

As shown in FIG. 14, an apparatus 10 having a set function includes an apparatus body 12 and a removable member 14 removably provided at the apparatus body 12.

In the interior of the removable member 14, a gear 16 is provided as an exemplary functional member having a set function. A pulley 18 that rotates together with the gear 16 is provided at a rotary shaft 16A of the gear 16. Further, a gear 20 is provided as an exemplary first gear at a side (left side in FIG. 14) of the removable member 14. A portion of the gear 20 is exposed from an opening 14A of the removable member 14.

A pulley 22 that rotates together with the gear 20 is provided at a rotary shaft 20A of the gear 20. An endless belt 25 is wound upon the pulley 22 and the pulley 18, so that rotational force of the pulley 22 is transmitted to the pulley 18.

The interior of the apparatus body 12 includes a gear 24, gears 26, and a motor 30 serving as a drive source including a driving gear 28 engaging the gear 26. The gear 24 is an exemplary second gear that is exposed from a portion of the opening 12A and that engages the gear 20 of the removable member 14 mounted to the apparatus body 12. The gear 26 rotates by engaging the gear 24.

Further, a wire 32 that transmits information between the apparatus body 12 and the removable member 14 is provided in the interior of the apparatus body 12. A contact 34, provided at the opening 12A, is connected to an end portion of the wire 32.

A contact 36 that contacts the contact 34 when the removable member 14 is mounted to the apparatus body 12 is provided at the opening 14A of the removable member 14. A wire 38 that transmits information between the removable member 14 and the apparatus body 12 and whose end portion is connected to the contact 36 is provided in the interior of the removable member 14.

Figure 13A:
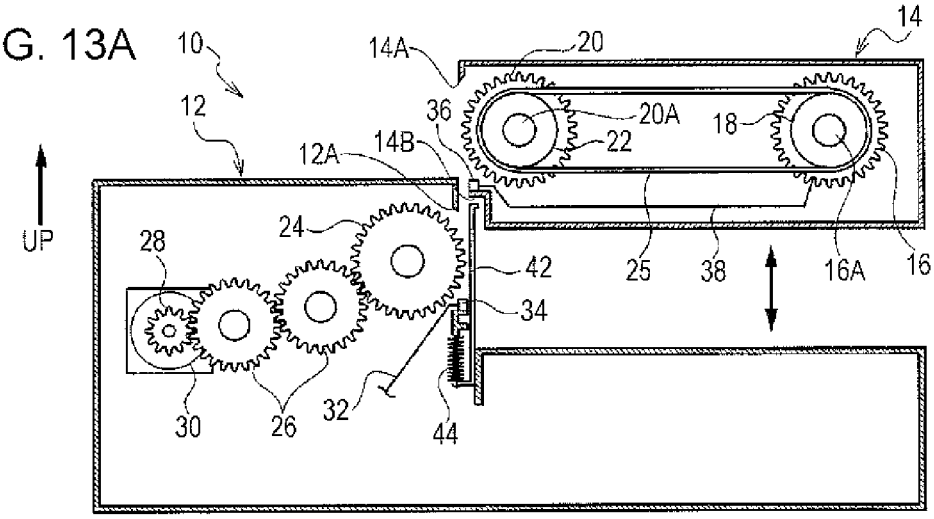
FIGS. 13A, 13B, and 13C illustrate operations of mounting the removable member according to the exemplary embodiment to the apparatus body.

As shown in FIG. 13A, a covering member 42 serving as an exemplary covering member that covers at least a portion of the gear 24 when the removable member 14 is dismounted from the apparatus body 12 is provided at the apparatus body 12.

More specifically, the covering member 42 is supported by the apparatus body 12 so as to be movable in an up-down direction. At its uppermost position (see FIG. 13A), the covering member 42 covers at least a portion of the contact 34 and the gear 24. At its bottommost position (see FIG. 13C), the covering member 42 allows the gear 24 to be exposed from the opening 12A and the gears 24 and 20 to engage each other.

A lower end of a coil spring 44 serving as an exemplary biasing member extending in the up-down direction is secured to a lower end portion of the covering member 42. An upper end of the coil spring 44 is secured to the apparatus body 12. Therefore, the coil spring 44 biases the covering member 42 upward.

The removable member 14 is provided with a notch section 14B that strikes an upper end portion of the covering member 42 and pushes the covering member 42 downward when an attempt is made to mount the removable member 14 to the apparatus body 12 and the removable member 14 is brought closer to the apparatus body 12 from an upper side thereof.

Next, the operations (actions) of mounting and dismounting the removable member 14 to and from the apparatus body 12 will be described.

As shown in FIGS. 13A, when the removable member 14 is to be mounted to the apparatus body 12, the removable member 14 is moved closer to the apparatus body 12 from thereabove. By this, the notch section 14B of the removable member 14 strikes the upper end portion of the covering member 42 covering the gear 24.

Figure 13B:
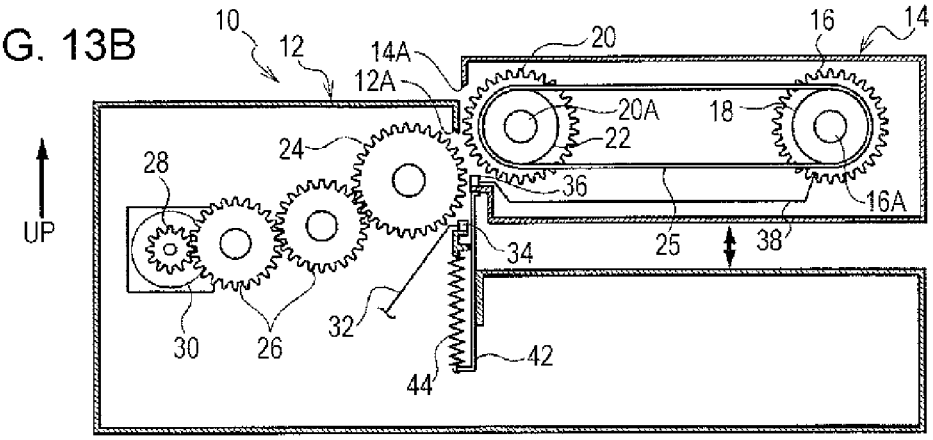

As shown in FIG. 13B, when the removable member 14 is moved downward and more closer to the apparatus body 12, the covering member 42 is pushed by the notch section 14B, and moves downward against a biasing force of the coil spring 44.

Figure 13C:
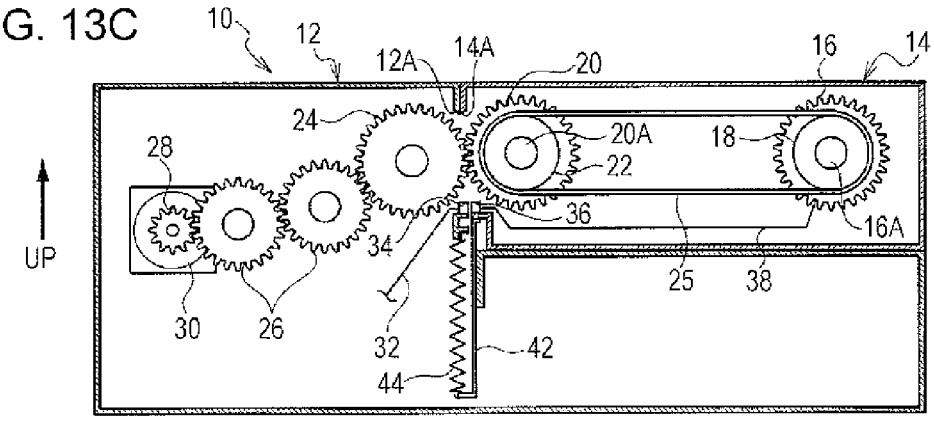

As shown in FIG. 13C, when the removable member 14 is mounted to the apparatus body 12, the covering member 42 is moved downward, so that the gear 24 and the contact 34 are exposed from the opening 12A. Then, the gear 24 and the gear 20 of the removable member 14 engage each other, so that the contact 34 and the contact 36 of the removable member 14 contact each other.

This causes driving force and information to be transmitted between the apparatus body 12 and the removable member 14.

The removable member 14 is dismounted from the apparatus body 12 by performing the above-described steps in the reverse order.

Next, a practical form of the exemplary embodiment will be described in detail, with the above-described apparatus 10 being an image forming apparatus and the removable member 14 being a toner containing member.

Overall Structure

Figure 5:
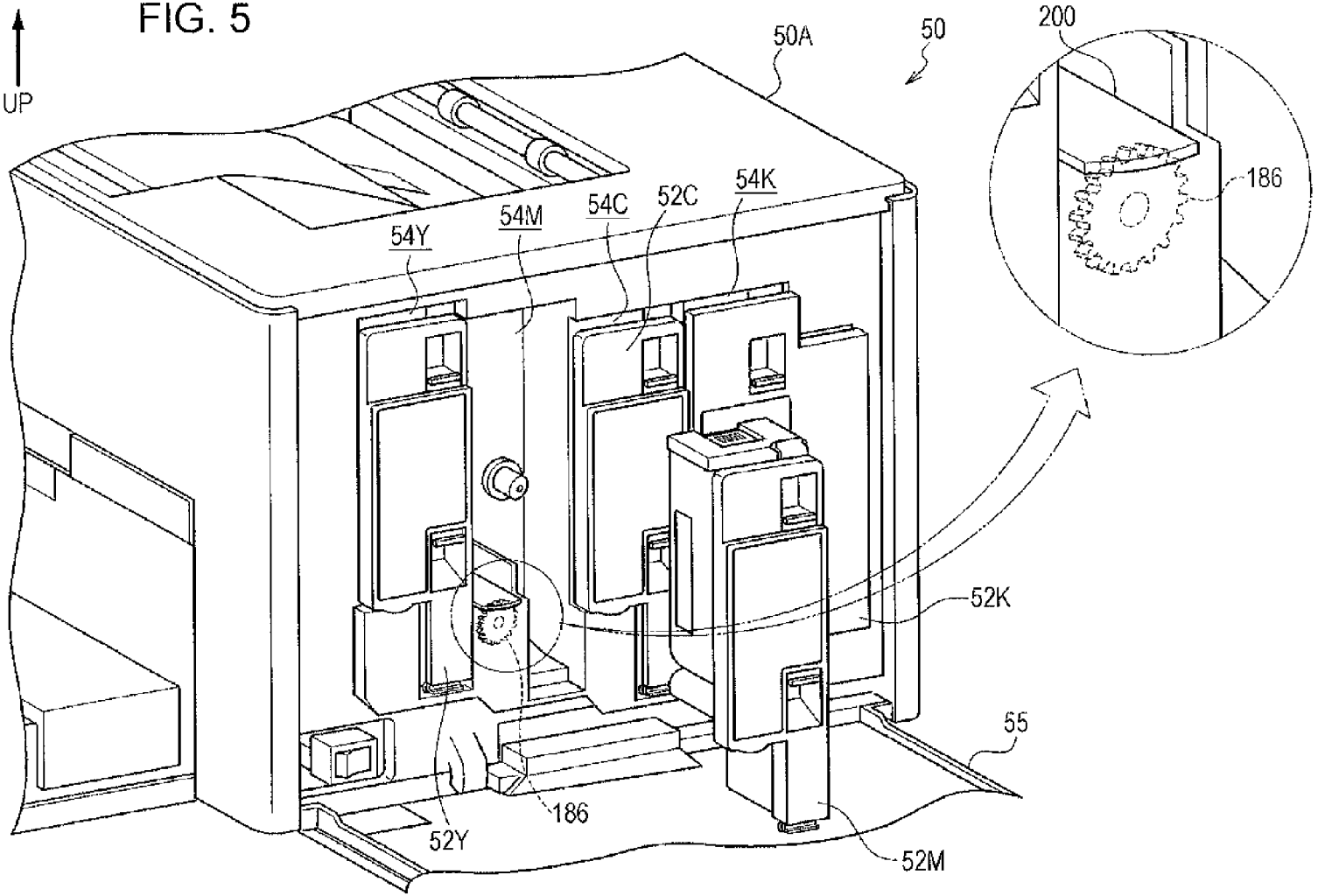
FIG. 5 is a perspective view of toner cartridges according to the exemplary embodiment of the present invention and the body of the image forming apparatus.
Figure 6:
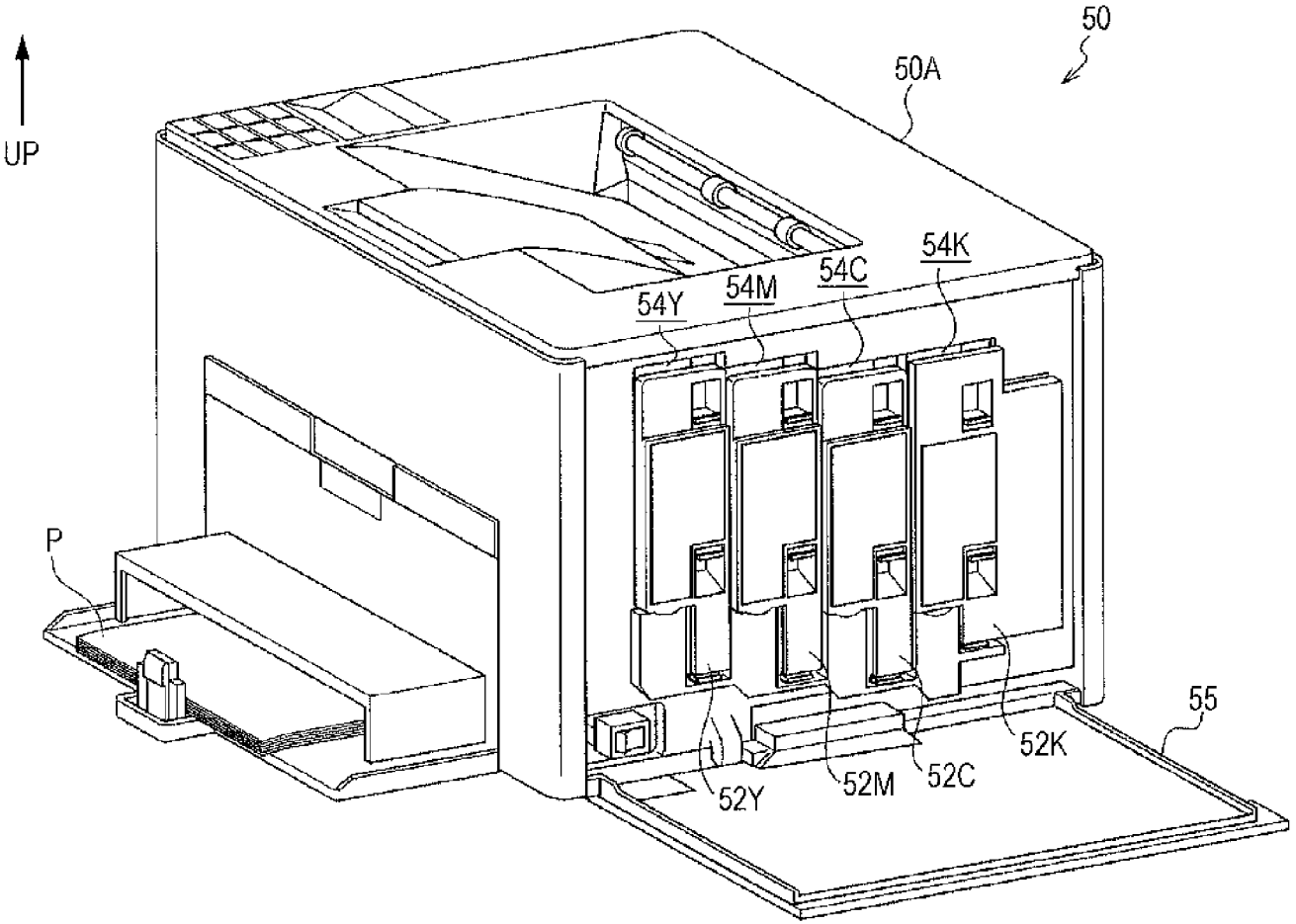
FIG. 6 is a perspective view of the toner cartridge according to the exemplary embodiment of the present invention and the body of the image forming apparatus.

As shown in FIGS. 5 and 6, a cover 55 that covers and uncovers a side of an image forming apparatus 50 is provided at a side portion of the image forming apparatus 50. Toner cartridges 52Y, 52M, 52C, and 52K, and recessed cartridge holding sections 54Y, 54M, 54C, and 54K are provided inwardly of the cover 55. The toner cartridges 52Y, 52M, 52C, and 52K are exemplary toner containing members that are inclined with respect to a horizontal direction and that contain toners of respective colors, that is, yellow (Y) toner, magenta (M) toner, cyan (C) toner, and black (K) toner. The cartridge holding sections 54Y, 54M, 54C, and 54K removably hold the toner cartridges 52Y, 52M, 52C, and 52K of the respective colors.

That is, the toner cartridges 52Y, 52M, 52C, and 52K are replaceably (removably) provided with respect to an apparatus body 50A of the image forming apparatus 50. In the description below, the reference characters Y, M, C, and K of the members corresponding to the respective colors, yellow, magenta, cyan, and black will be omitted unless it is necessary to distinguish between the members. The toner cartridges 52 will be described in detail later.

Figure 7:
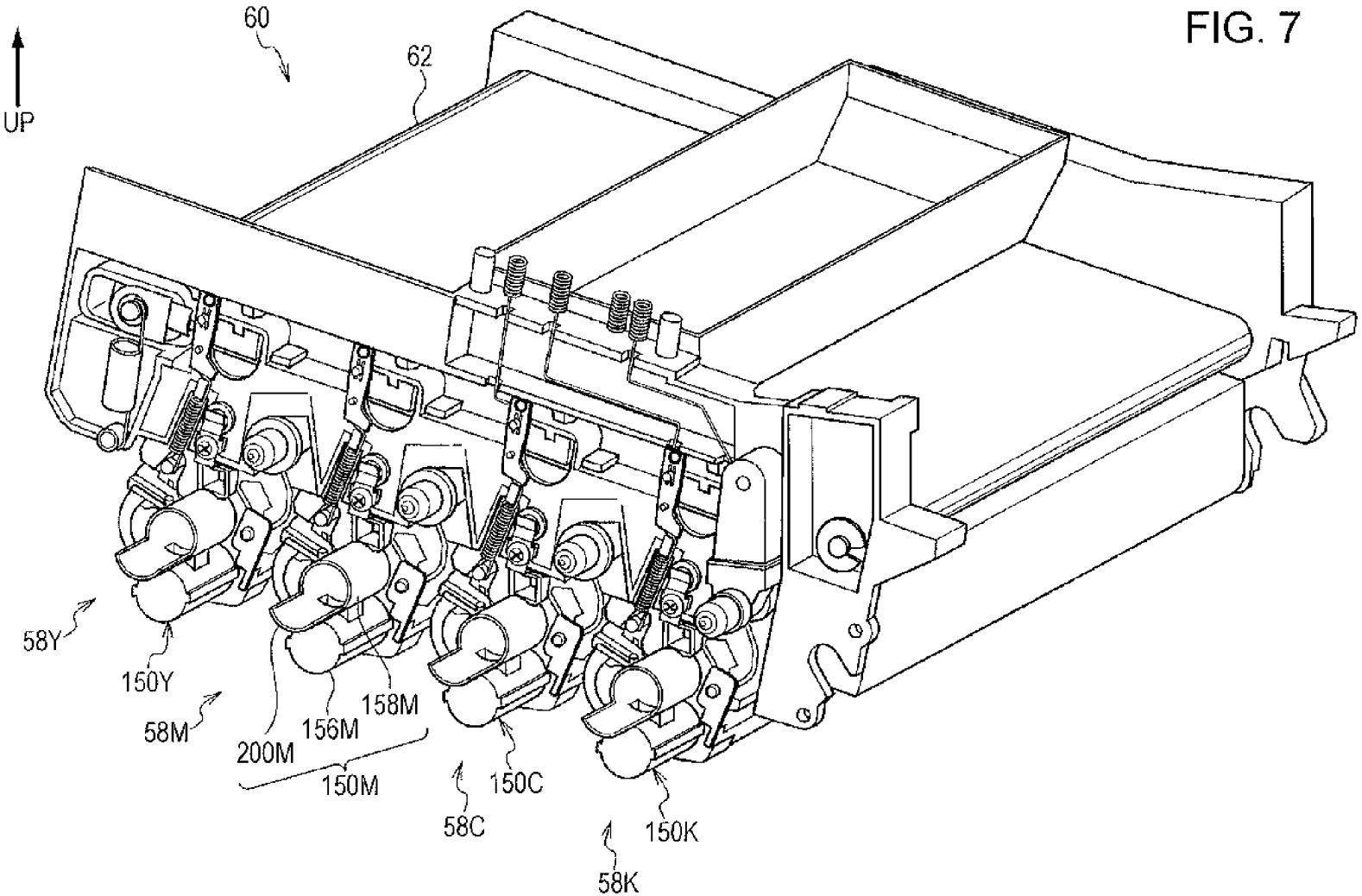
FIG. 7 is a perspective view of a transfer section and image forming units for respective colors used in the image forming apparatus according to an exemplary embodiment of the present invention.
Figure 11:
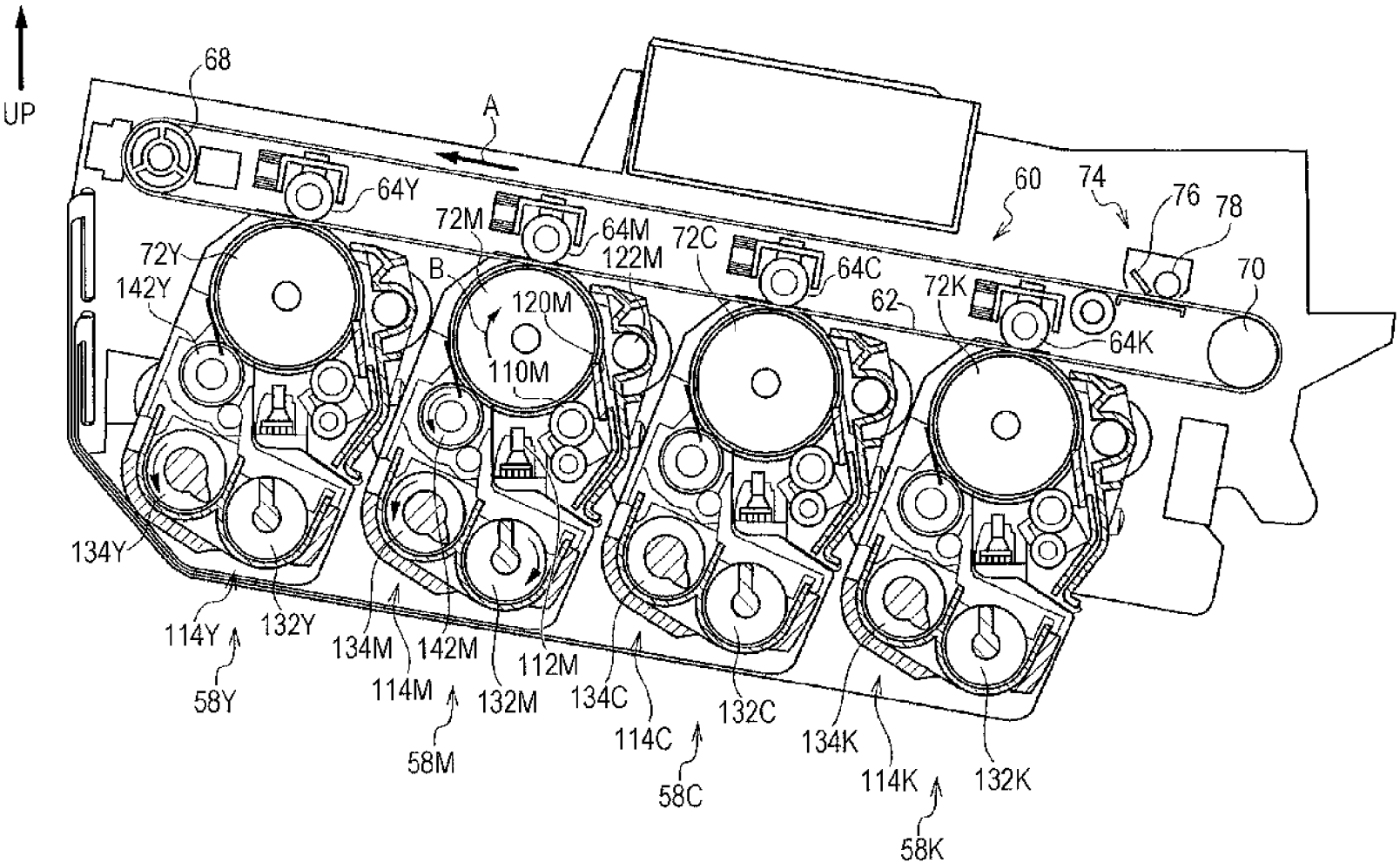
FIG. 11 is a side view of the transfer section and the image forming units for the respective colors used in the image forming apparatus according to the exemplary embodiment of the present invention.
Figure 12:
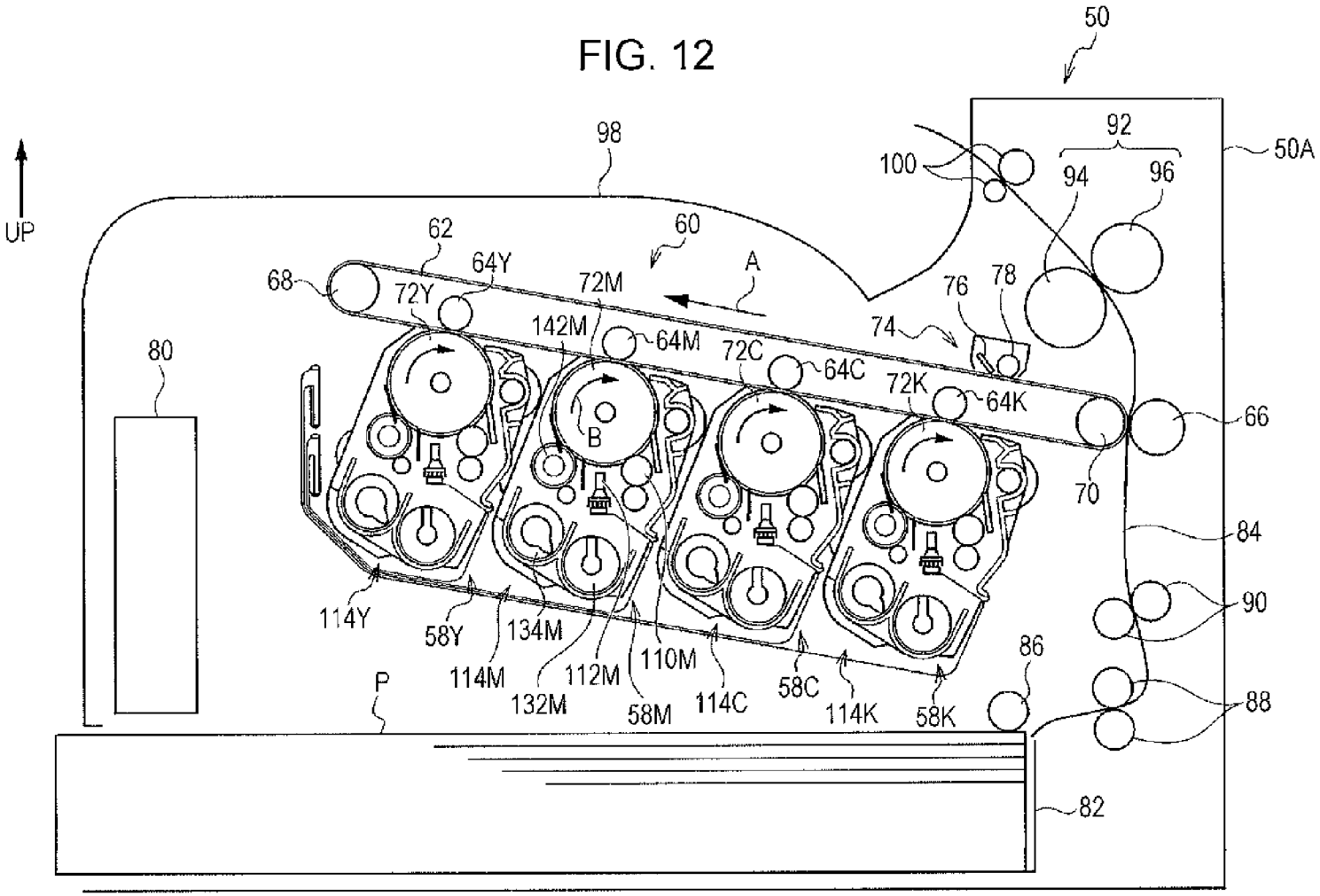
FIG. 12 is a schematic structural view of the image forming apparatus according to the exemplary embodiment of the present invention.

As shown in FIGS. 7, 11, and 12, four image forming units 58 (58Y, 58M, 58C, 58K) that form toner images corresponding to the respective colors Y, M, C, and K are provided in the interior of the apparatus body 50A of the image forming apparatus 50 so as to be inclined with respect to the horizontal direction. Developers are mixtures of nonmagnetic toners and magnetic carriers.

A transfer section 60 is provided above the image forming units 58Y, 58M, 58C, and 58K. The transfer section 60 includes an endless intermediate transfer belt 62, four first transfer rollers 64Y, 64M, 64C, and 64K, and a second transfer roller 66. The first transfer rollers 64Y, 64M, 64C, and 64K are disposed inwardly of the intermediate transfer belt 62, and transfers toner images formed at the respective image forming units 58Y, 58M, 58C, and 58K onto the intermediate transfer belt 62. The second transfer roller 66 transfers the toner images superimposed upon each other on the intermediate transfer belt 62 onto a sheet material P serving as a recording medium.

The intermediate transfer belt 62 is wound between a tension applying roller 68 and a drive roller 70 with a certain tension. The tension applying roller 68 applies a tension to the intermediate transfer belt 62. The drive roller 70 is disposed so as to oppose the second transfer roller 66, and is driven by a motor (not shown). The intermediate transfer belt 62 is such as to move in the direction of arrow A (counterclockwise direction) shown in FIG. 12 by the drive roller 70.

Further, the first transfer rollers 64 are disposed so as to oppose image carrying members 72 (described later) provided at the respective image forming units 58 with the intermediate transfer belt 62 being disposed therebetween. A power supply unit (not shown) is capable of applying a transfer bias voltage having a polarity (for example, a positive polarity in the exemplary embodiment) that is opposite to a toner polarity to the first transfer rollers 64. The power supply unit also applies a transfer bias voltage having a polarity that is opposite to the toner polarity to the second transfer roller 66.

A cleaning device 74 is provided at the outer peripheral surface of the intermediate transfer belt 62 between the tension applying roller 68 and the drive roller 70. The cleaning device 74 includes a cleaning blade 76 and a transporting member 78. The cleaning blade 76 scrapes off any residual toner from the outer peripheral surface of the intermediate transfer belt 62. The transporting member 78 transports the toner scraped off by the cleaning blade 76 to the outer side of the intermediate transfer belt 62.

A control unit 80 that controls driving of each portion of the image forming apparatus 50 is provided at a side portion of the interior of the apparatus body 50A of the image forming apparatus 50.

A feeding section 82 that holds sheet materials P is provided below the image forming units 58 of the respective colors. A sheet transport path 84 for transporting the sheet materials P held in the feeding section 82 is provided upward from an end portion of the feeding section 82. A delivery roller 86, separating rollers 88 for separating and transporting the sheets, and positioning rollers 90 are provided in the sheet transport path 84. The delivery roller 86 sends out the sheet materials P from the feeding section 82. The separating rollers 88 feed the sheet materials P one at a time. The positioning rollers 90 match a timing of transporting the sheet materials P and a timing of moving toner images on the intermediate transfer belt 62.

A fixing device 92 is provided at a downstream side in a transport direction of the sheet materials P from the second transfer roller 66 (hereunder simply referred to as "downstream side"). The fixing device 92 fixes the toner images transferred to the sheet material P by the second transfer roller 66 onto the sheet material P using heat and pressure. The fixing device 92 includes a heating roller 94 and a pressure roller 96. The heating roller 94 is heated, and the pressure roller 96 press-contacts the heating roller 94.

Discharge rollers 100 are provided at the downstream side of the fixing device 92. The discharge rollers 100 discharge the sheet material P to which the toner images are fixed by the fixing device 92 to an upper portion of the image forming apparatus 50.

Next, the image forming units 58 will be described using the image forming unit 58M as an example. Since the structures of the image forming units 58Y, 58C, and 58K corresponding to the other colors are similar to that of the image forming unit 58M, the descriptions thereof will be omitted. Each structural member of the image forming unit 58 is shown without the reference character M.

Figure 10:
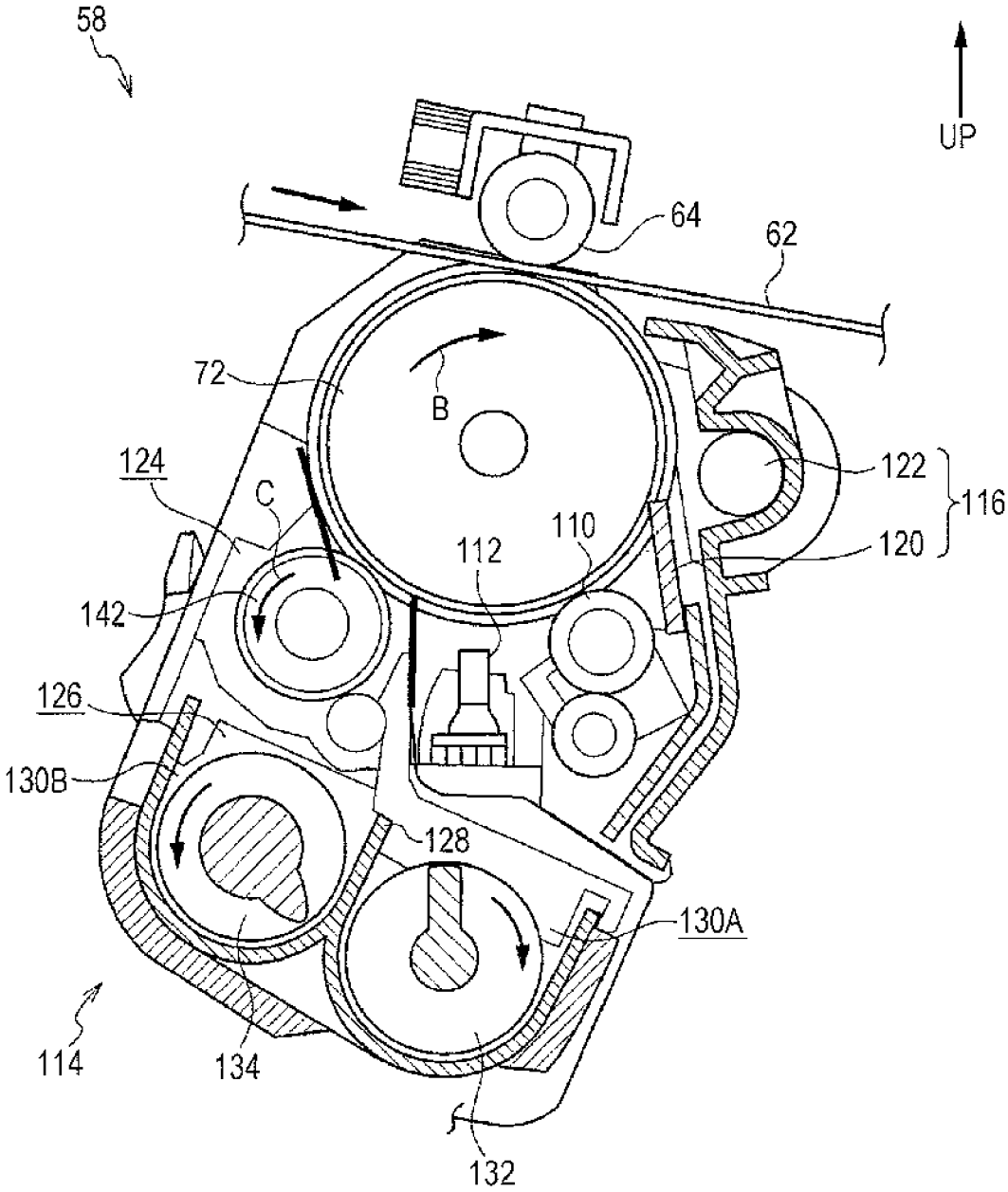
FIG. 10 is a side view of the image forming unit used in the image forming apparatus according to the exemplary embodiment of the present invention.

As shown in FIGS. 10, 11, and 12, the image forming unit 58 includes the image carrying member 72 that is rotated and driven in the direction of arrow B (clockwise direction). A charging roller 110, a LED head 112, a developing section 114, an electricity removing device (not shown), and a cleaning device 116 are provided around the image carrying member 72. The charging roller 110 contacts the surface of the image carrying member 72 and uniformly charges the image carrying member 72. The LED head 112 irradiates the surface of the image carrying member 72 with exposure light. The developing section 114 develops an electrostatic latent image formed on the image carrying member 72 by the exposure light into a toner image with the developer (toner) of the corresponding color. The electricity removing device removes electricity by irradiating with light the image carrying member 72 after the toner image is transferred to the intermediate transfer belt 62. The cleaning device 116 cleans the surface of the image carrying member 72 after the removal of electricity. The charging roller 110, the LED head 112, the developing section 114, and the cleaning device 116 are disposed in that order so as to oppose the surface of the image carrying member 72 from the upstream side to the downstream side in the direction of rotation of the image carrying member 72.

As shown in FIG. 10, the cleaning device 116 includes a plate-like blade member 120 and a transporting member 122. The blade member 120 scrapes off, for example, any residual toner from the surface of the image carrying member 72 when an end portion thereof strikes the surface of the image carrying member 72. The transporting member 122 transports, for example, the toner scraped off by the blade member 120 to the outer side of the image carrying member 72 (outer side in a direction away from a viewer of FIG. 10 in a plane of FIG. 10).

Further, the developing section 114 includes a development chamber 124 and a stirring transport chamber 126 provided below the development chamber 124 and stirring (mixing) the developer supplied from the toner cartridge 52 (see FIG. 6) and transporting the stirred developer to the development chamber 124.

The stirring transport chamber 126 is partitioned by a partition wall 128 protruding from the bottom surface thereof. As a result, two stirring paths, that is, a first stirring path 130A and a second stirring path 130B, are provided in the stirring transport chamber 126. A first connection opening and a second connection opening that are open (not shown) are formed at two ends of the partition wall 128. The first connection opening and the second connection opening connect the first stirring path 130A and the second stirring path 130B to each other. The upper side of the second stirring path 130B is open, and is connected to the development chamber 124.

A first stirring transport member 132 that stirs and transports the developer is disposed in the first stirring path 130A. A second stirring transport member 134 that stirs and transports the developer is disposed in the second stirring path 130B.

Figure 3:
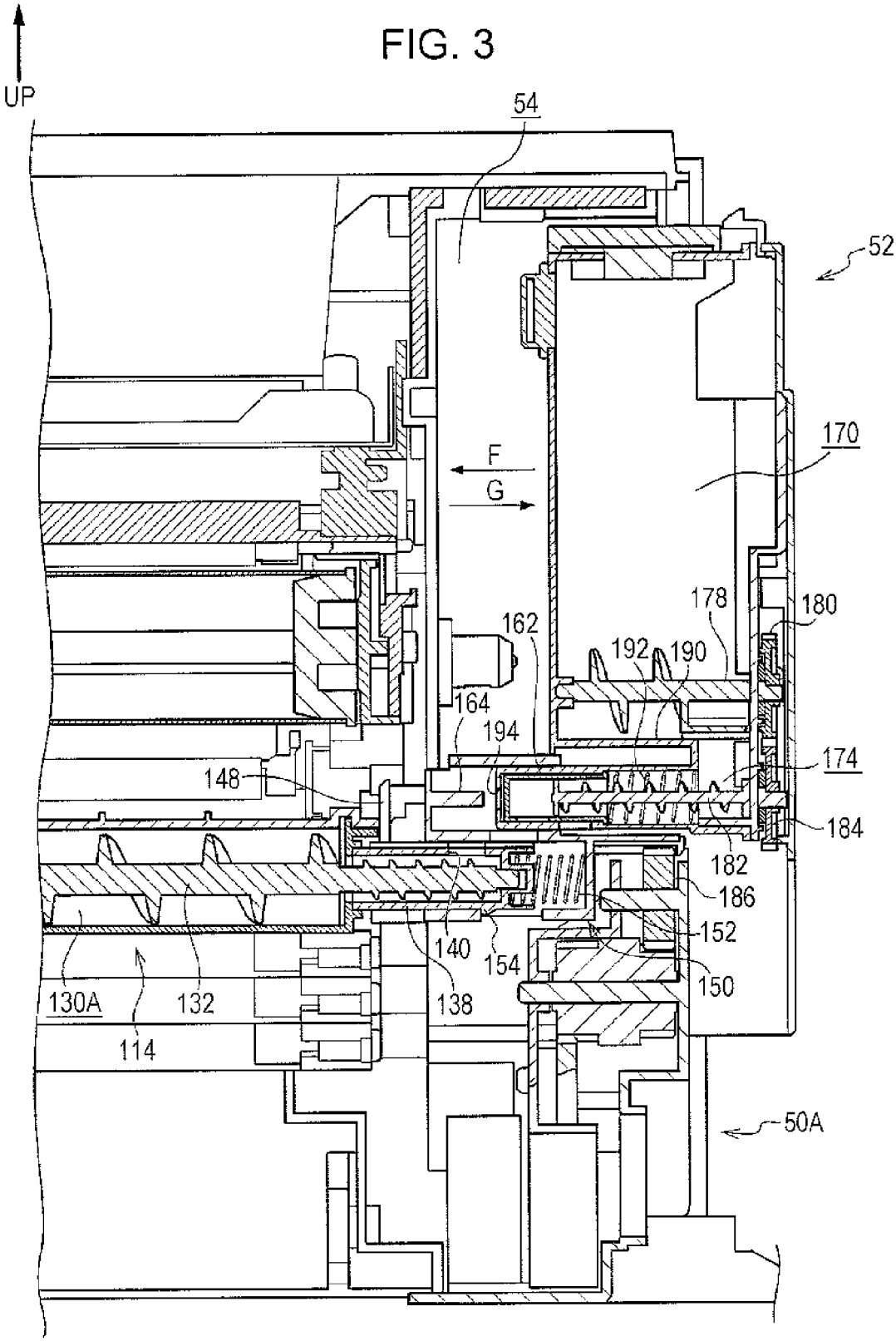
FIG. 3 is a sectional view showing the state in which the toner cartridge according to the exemplary embodiment of the present invention and the body of the image forming apparatus are dismounted from each other.
Figure 4:
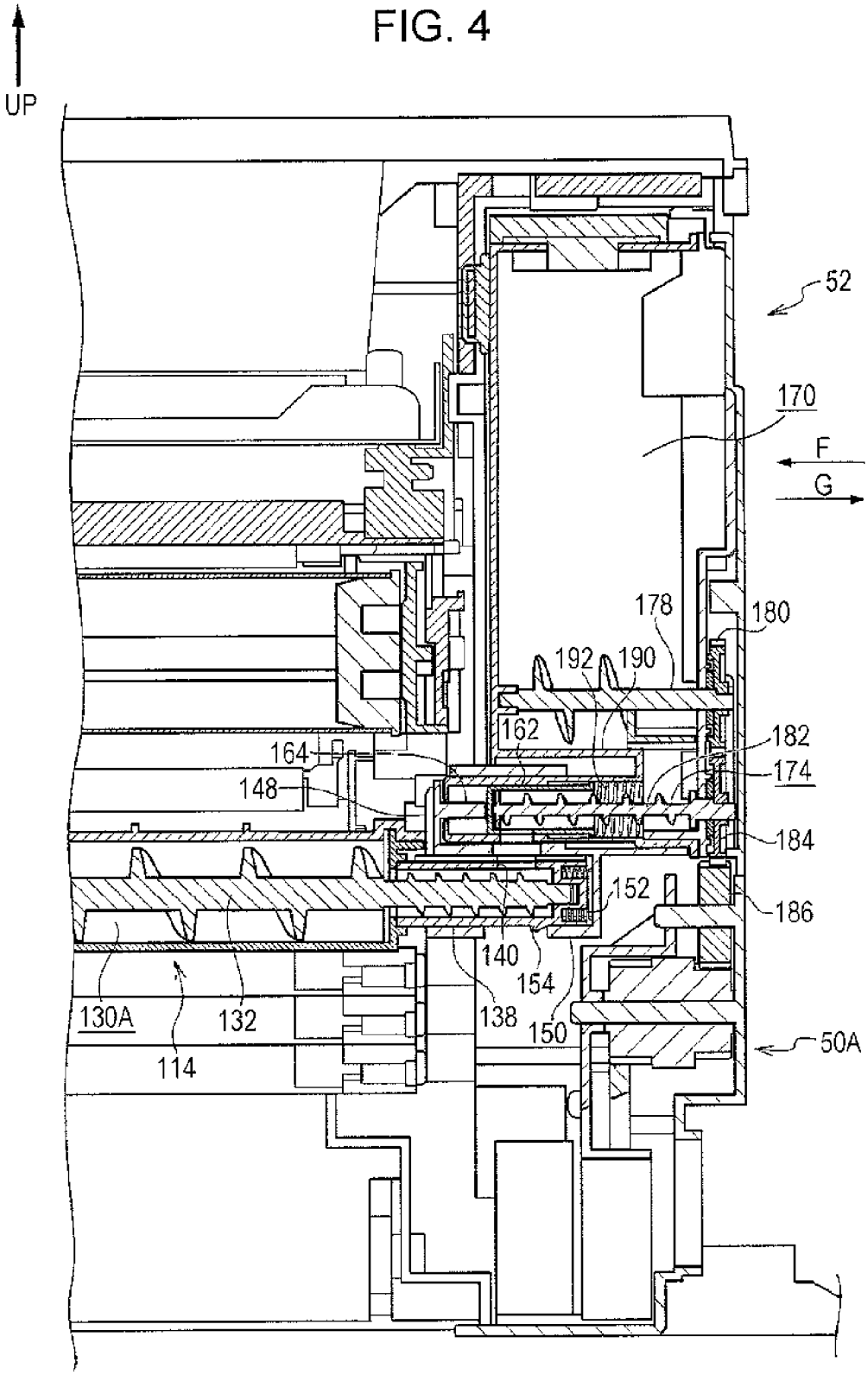
FIG. 4 is a sectional view showing the state in which the toner cartridge according to the exemplary embodiment of the present invention and the body of the image forming apparatus are mounted to each other.

Further, as shown in FIGS. 3 and 4, a protrusion 138 protruding outwardly from an end side of the first stirring path 130A is formed at one end of the first stirring path 130A. An opening 140 serving as an exemplary receiving opening to which toner is supplied from the toner cartridge 52 is formed at the upper side of the protrusion 138.

As shown in FIG. 10, the first stirring transport member 132 and the second stirring transport member 134 are driven by a driving unit, such as a motor and a gear (not shown). This causes the developer in the stirring transport chamber 126 to be mixed with the toner supplied from the toner cartridge 52 (see FIG. 5), and to circulate in the first stirring path 130A and the second stirring path 130B.

The development chamber 124 is connected to the second stirring path 130B. A development roller 142 that rotates in the direction of arrow C (counterclockwise direction) is provided in the development chamber 124, with a longitudinal direction of the image carrying member 72 being an axial direction. The development roller 142 is disposed so as to oppose the outer peripheral surface of the image carrying member 72 through an opening (not shown) formed in the development chamber 124. An electrical field is formed between the development roller 142 and the image carrying member 72 by applying a bias voltage thereto.

By virtue of this structure, the developer supplied from the second stirring transport member 134 is supplied to the surface of the development roller 142. The toner in the developer supplied to the surface of the development roller 142 moves towards a latent image formed on the rotating image carrying member 72. The latent image formed on the image carrying member 72 is developed to form a toner image.

Structure of Principal Portion

Next, the toner cartridge 52 and a toner-cartridge mounting structure 146 will be described.

Here, the toner cartridge 52M will be described as an example. The structures of the toner cartridge 52Y, 52C, and 52M are similar to that of the toner cartridge 52M (see FIG. 8). In contrast, as shown in FIG. 9, considering the consumption amount of black toner, the black toner cartridge 52K is larger than the other toner cartridges 52Y, 52M, and 52C. However, since the principle of a mechanism for mounting and dismounting the black toner cartridge 52K to and from the apparatus body 50A is similar, the toner cartridge 52K will not be described. Each structural member of the toner cartridge 52M will be described without using the reference character M.

As shown in FIGS. 3, 4, 5, and 6, when the toner cartridge 52 is pushed towards the cartridge holding section 54 in a mounting direction F (in the direction of arrow F shown in FIGS. 3 and 4), the toner cartridge 52 is mounted to the apparatus body 50A. When the toner cartridge 52 is drawn out from the cartridge holding section 54 in a dismounting direction G (in the direction of arrow G shown in FIGS. 3 and 4), the toner cartridge 52 is dismounted from the apparatus body 50A.

As shown in FIGS. 2A, 2B, 3, and 4, the developing section 114 is provided with the protrusion 138, a developing-section shutter 150 (see FIG. 7), a coil spring 152, a stopper 148, and a stopper 154. The protrusion 138 protrudes to the outer side of the first stirring path 130A. The developing-section shutter 150 is an exemplary opening-closing member that opens and closes the opening 140 by sliding with respect to the protrusion 140 along a longitudinal direction of the protrusion 138. The coil spring 152 is an exemplary biasing member that biases the developing-section shutter 150 in the dismounting direction G. The stopper 148 restricts a range of movement of the developing-section shutter 150 in the mounting direction F. The stopper 154 restricts a range of movement of the developing-section shutter 150 in the dismounting direction G.

The developing-section shutter 150 has a shutter lower portion 156 and a shutter upper portion 158. The shutter lower portion 156 has a bottom, has a cylindrical shape, and covers the outer periphery of the protrusion 138. The shutter upper portion 158 has a bottom, has a cylindrical shape, is provided above the shutter lower portion 156, and is integrated to the shutter lower portion 156. (See FIG. 7.)

A rod-like protrusion 164 that contacts a bottom portion of a cartridge shutter 162 having a bottom and a cylindrical shape (described later) is formed at the shutter upper portion 158. The aforementioned coil spring 152 contacts the shutter lower portion 156 from its inner side. More specifically, the coil spring 152 is disposed in a compressed state between an end of the protrusion 138 and a bottom portion of the shutter lower portion 156. By this, a biasing force of the coil spring 152 is applied to the shutter lower portion 156.

The opening 140 to which the toner is supplied from the toner cartridge 52 is formed in an upper portion of the protrusion 138 of the developing section 114. An opening 166 through which the toner that is supplied to the developing section 114 passes is formed in a wall between the shutter lower portion 156 and the shutter upper portion 158.

A setting position of the opening 166 is situated where it overlaps the opening 140 and the opening 140 is open when the developing-section shutter 150 strikes the stopper 148, and where it separates from the opening 140 and the opening 140 is closed when the developing-section shutter 150 strikes the stopper 154.

More specifically, in a state in which the toner cartridge 52 is not mounted to the apparatus body 50A (FIG. 2A), the biasing force of the coil spring 152 causes the developing-section shutter 150 to move in the dismounting direction G and strike the stopper 154, so that the opening 166 separates from the opening 140, thereby closing the opening 140.

In contrast, when the toner cartridge 52 is mounted to the apparatus body 50A (FIG. 2B), the cartridge 164 is pushed towards the cartridge shutter 162, so that the developing-section shutter 150 moves in the mounting direction F and strikes the stopper 148, so that the opening 166 overlaps the opening 140, thereby opening the opening 140.

A covering section 200 is integrated to the wall between the shutter upper portion 158 and the shutter lower portion 156 (see FIG. 7). The covering section 200 is an exemplary covering member that covers at least a portion of a gear 186 serving as an exemplary second gear protruding in the dismounting direction G.

More specifically, in the state in which the toner cartridge 52 is not mounted to the apparatus body 50A (FIG. 2A), the biasing force of the coil spring 152 causes the developing-section shutter 150 to move in the dismounting direction G and strike the stopper 154, so that the covering section 200 covers substantially the entire upper portion of the gear 186. (See FIG. 5.)

In contrast, in the state in which the toner cartridge 52 is mounted to the apparatus body 50A (see FIG. 2B), the protrusion 164 is pushed towards the cartridge shutter 162, so that the developing-section shutter 150 moves in the mounting direction F and strikes the stopper 148, thereby moving the covering section 200. This causes the upper portion of the gear 186 to be exposed, so that a gear 184, serving as an exemplary first gear (described later) provided at the toner cartridge 52, engages the gear 186.

Figure 8:
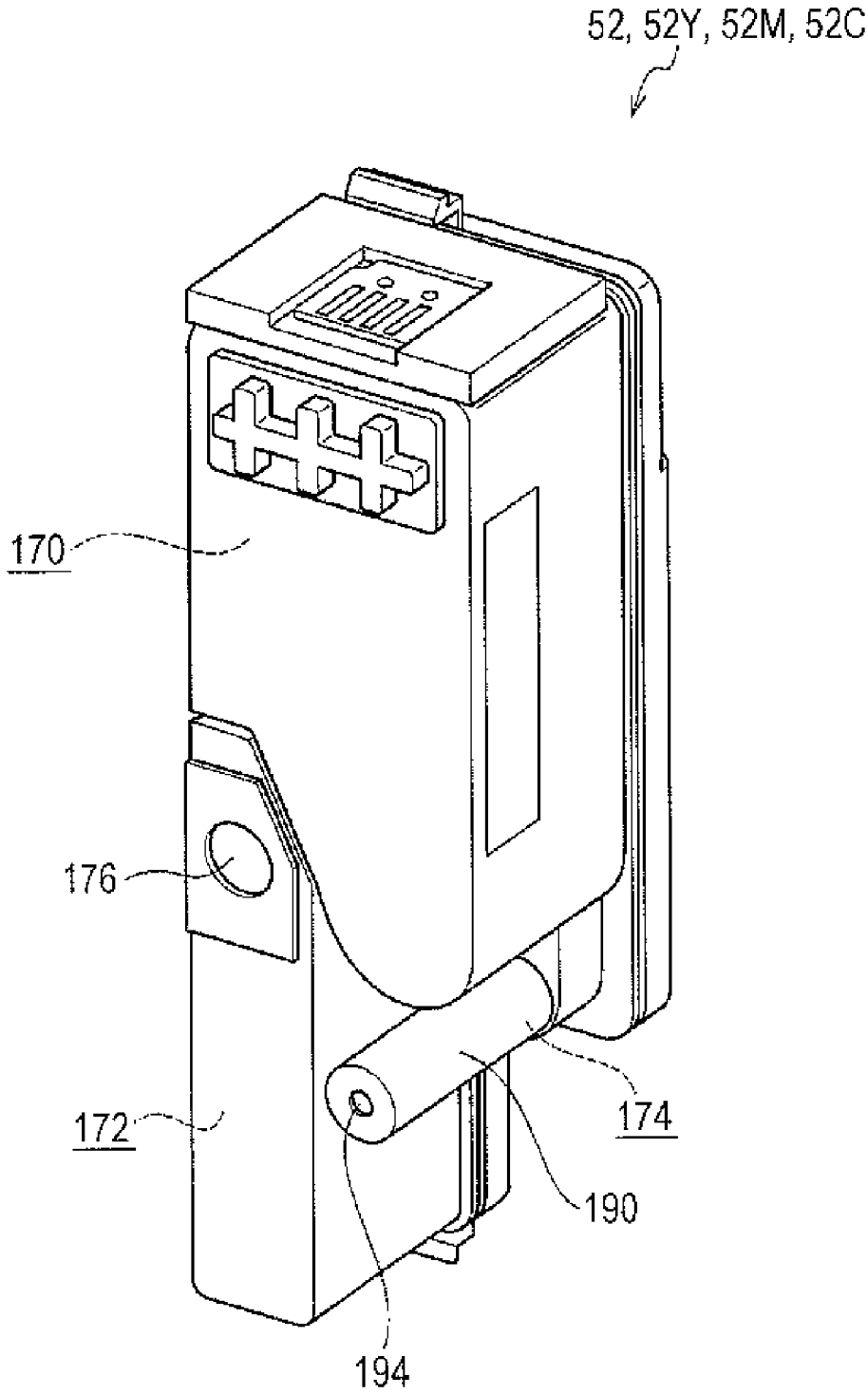
FIG. 8 is a perspective view of a toner cartridge used in the image forming apparatus according to the exemplary embodiment of the present invention.
Figure 9:
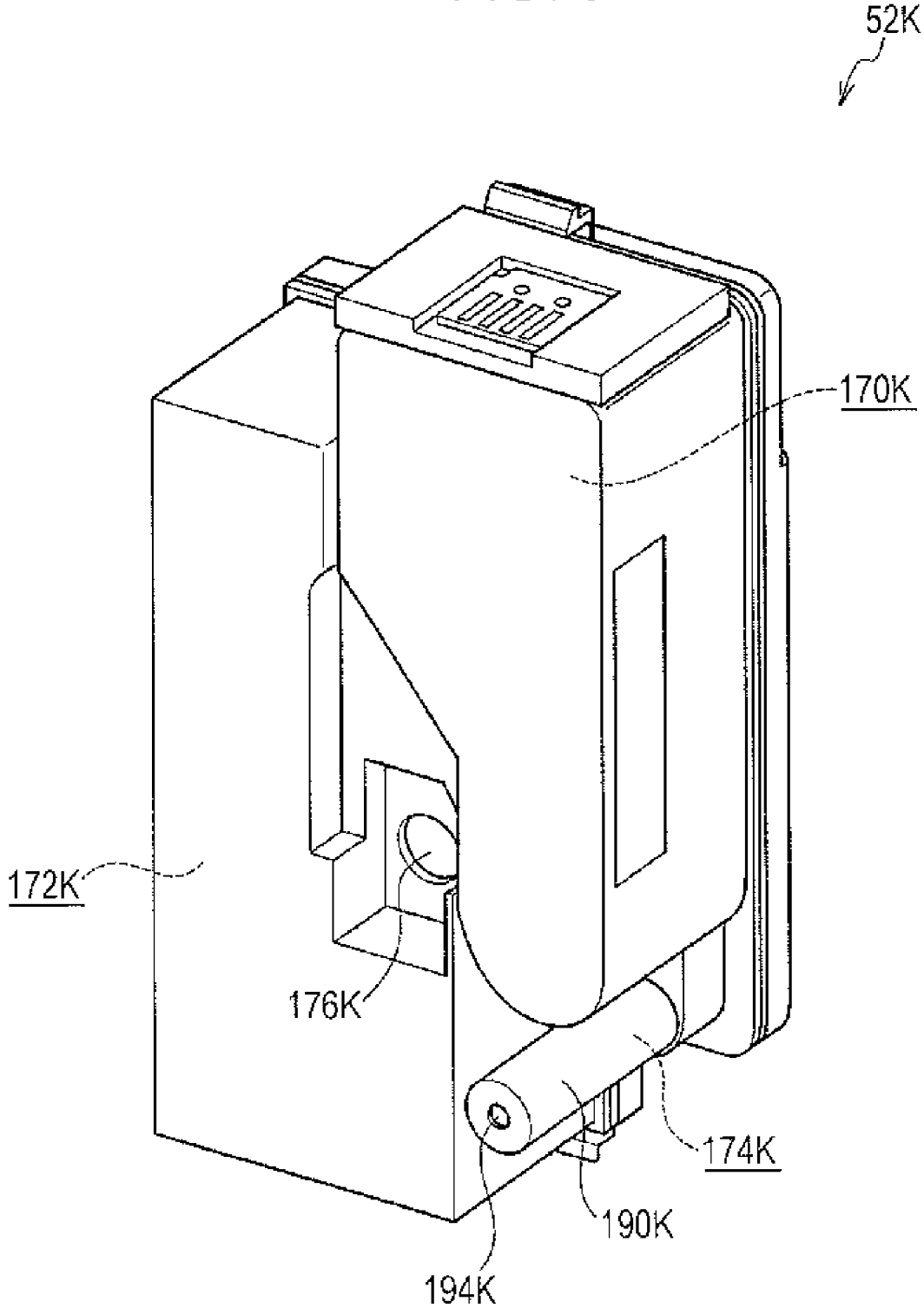
FIG. 9 is a perspective view of a toner cartridge used in the image forming apparatus according to the exemplary embodiment of the present invention.

As shown in FIGS. 8 and 9, a toner containing chamber 170, a toner discharge chamber 172, and a toner delivery chamber 174 are provided in the interior of the toner cartridge 52. The toner containing chamber 170 contains new toner that is supplied to the developing section 114. The toner discharge chamber 172 is where discharge toner is discharged from the developing section 114 (see FIG. 10). The toner delivery chamber 174 is provided below the toner containing chamber 170, and delivers toner contained in the toner containing chamber 170 to the developing section 114.

A receiving opening 176 is provided in a wall surface of the toner discharge chamber 172 adjacent to the image forming apparatus body 50A. When the toner cartridge 52 is mounted to the apparatus body 50A, the receiving opening 176 is connected to the cleaning device 116 (see FIG. 10), and receives the discharge toner transported by the transporting member 122.

Further, as shown in FIGS. 3 and 4, the toner containing chamber 170 is provided with a stirring member 178 that is an exemplary functional member that rotates and stirs the contained toner. A gear 180 that rotates together with the stirring member 178 is provided at an end portion of the stirring member 178.

The toner delivery chamber 174 is provided with a stirring transport chamber 182 that stirs and transports toner to be delivered to the developing section 114. The aforementioned gear 184 that engages the gear 180, provided at the end portion of the stirring member 178, is provided at an end portion of the stirring transport member 182. A lower end portion of the gear 184 is exposed to the outside. When the toner cartridge 52 is mounted to the apparatus body 50A, as mentioned above, the lower end portion of the gear 184 engages an upper end portion of the gear 186, provided at the apparatus body 50A.

The gear 186, provided at the apparatus body 50A, is rotated by transmitting a driving force of a motor (not shown). By rotating the gear 186, a driving force is transmitted to the stirring transport member 182 and the stirring member 178 of the toner cartridge 52, mounted to the apparatus body 50A, through the gears 184 and 180. A one-way clutch (not shown) is provided at a rotary shaft of the gear 186. It is rotatable in one direction. Therefore, as mentioned above, the lower end portion of the gear 184 and the upper end portion of the gear 186 smoothly engage each other.

The toner delivery chamber 174 is formed by a housing section 190 having a bottom, having a cylindrical shape, and extending in the mounting direction F of the toner cartridge 52 (see FIGS. 8 and 9). The toner delivery chamber 174 is provided with the aforementioned cartridge shutter 162 that slides along the inner peripheral surface of the housing section 190 and that is movable in the longitudinal direction of the toner delivery chamber 174, and a coil spring 192 that biases the cartridge shutter 162 in the mounting direction F.

An opening 194 into which the protrusion 164, provided at the developing-section shutter 150, is inserted when the toner cartridge 52 is mounted to the apparatus body 50A is formed in a bottom portion of the housing section 190. A biasing force of the coil spring 192 that biases the cartridge shutter 162 is stronger than a biasing force of the coil spring 152 that biases the developing-section shutter 150.

An opening 196 is provided in a lower portion of the cartridge shutter 162. An opening 198 serving as an exemplary discharge opening is provided in a lower portion of the housing section 190. Setting positions of the openings 196 and 198 are situated where the openings 196 and 198 overlap each other and the opening 198 is disposed above the gear 186 in this state, when the toner cartridge 52 is mounted to the image forming apparatus 50.

More specifically, in the state in which the toner cartridge 52 is not mounted to the apparatus body 50A (FIG. 2A), the biasing force of the coil spring 192 causes the cartridge shutter 162 to move relative to the housing section 190 in the mounting direction F, and to strike the bottom portion of the housing section 190, so that the opening 196 moves away from the opening 198 to close the opening 198.

In contrast, in the state in which the toner cartridge 52 is mounted to the apparatus body 50A (FIG. 2B), the housing section 190 pushes the shutter upper portion 158, so that the developing-section shutter 150 moves in the mounting direction F, thereby causing the openings 166 and 140 to overlap each other. Further, the cartridge shutter 162 is pushed by the protrusion 164, and moves relative to the housing section 190 in the dismounting direction G, so that the opening 196 overlaps the opening 198, thereby opening the opening 198. Then, in this state, the openings 196 and 198, and the openings 140 and 166 overlap each other.

By mounting all of the toner cartridges 52 to the image forming apparatus 50A, an interlock is unlocked, thereby making it possible to operate the image forming apparatus 50.

As described above, the toner-cartridge mounting structure 146 includes the apparatus body 50A, the toner cartridge 52, the opening 140, the developing-section shutter 150, the coil spring 152, the gear 184, the gear 186, and the opening 198.

Operation

Next, a method of mounting and dismounting the toner cartridge 52 will be described.

As shown in FIG. 5, in order to mount the toner cartridge 52 to the apparatus body 50A, the cover 55 of the image forming apparatus 50 is opened, and the toner cartridge 52 is moved to a mounting reference position.

Figure 1A:
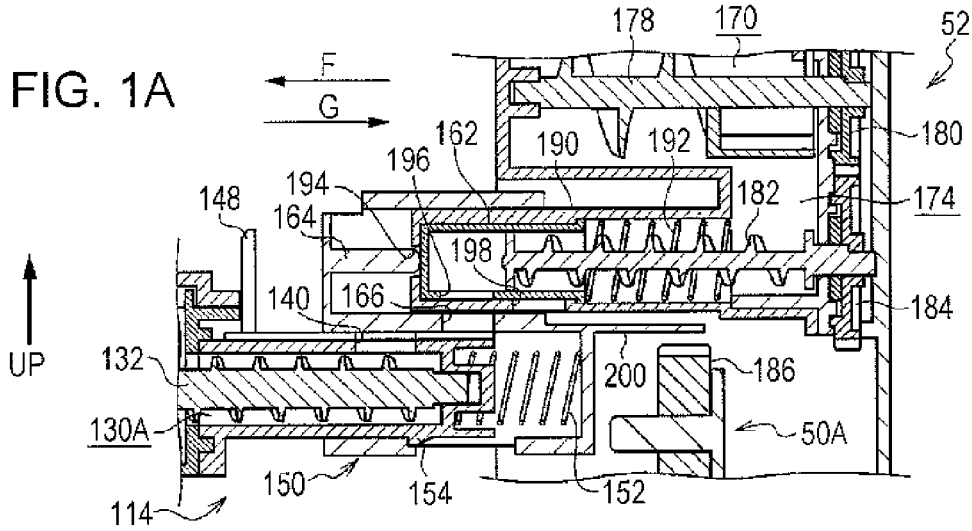
FIGS. 1A, 1B, and 1C illustrate operations of mounting a toner cartridge according to an exemplary embodiment of the present invention to a body of an image forming apparatus.
Figure 2A:
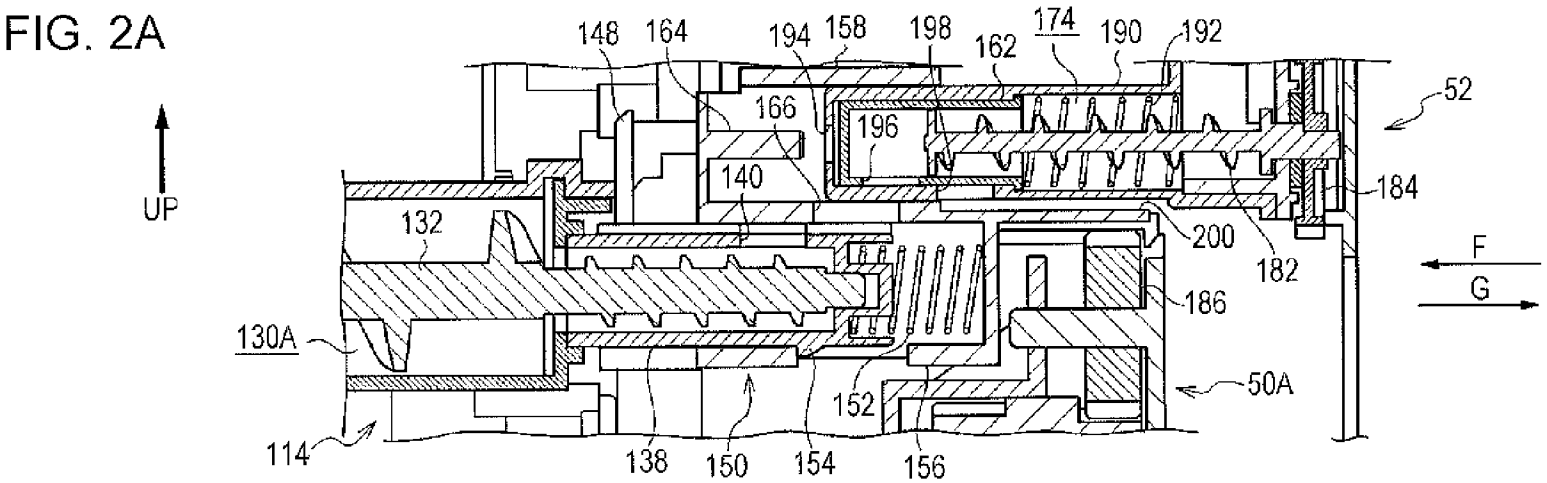
FIGS. 2A and 2B are enlarged sectional views showing a state in which the toner cartridge according to the exemplary embodiment of the present invention and the body of the image forming apparatus are dismounted from each other and a state in which the toner cartridge according to the exemplary embodiment of the present invention and the body of the image forming apparatus are mounted to each other.

As shown in FIGS. 1A, 2A, and 3, the toner cartridge 52 is moved in the mounting direction F, and the housing section 190 of the toner cartridge 52 is inserted into the shutter upper portion 158 of the developing-section shutter 150.

When the housing section 190 of the toner cartridge 52 is inserted into the shutter upper portion 158 of the developing-section shutter 150, the protrusion 164 of the developing-section shutter 150 passes through the opening 194 of the housing section 190, and strikes the bottom portion of the cartridge shutter 162. Here, the biasing force of the coil spring 152 that biases the developing-section shutter 150 is weaker than the biasing force of the coil spring 192 that biases the cartridge shutter 162. Therefore, the cartridge shutter 162 pushes the developing-section shutter 150, so that the developing-section shutter 150 moves in the mounting direction F.

Figure 1B:
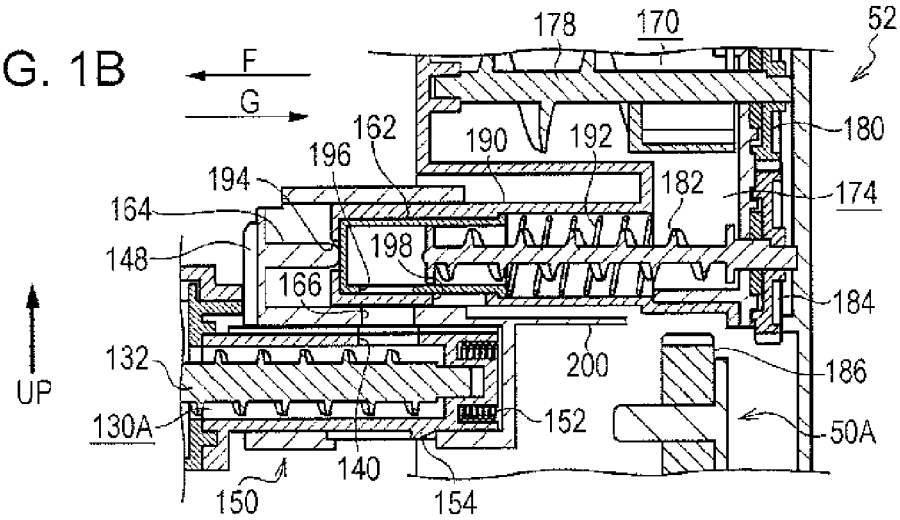

When the developing-section shutter 150 moves in the mounting direction F, so that the shutter upper portion 158 of the developing-section shutter 150 strikes the stopper 148, as shown in FIG. 1B, the opening 166 of the developing-section shutter 150 overlaps the opening 140 of the protrusion 138. The covering section 200 covering the upper side of the gear 186 also moves in the mounting direction F, so that the upper end portion of the gear 186 is exposed, thereby making it possible for the gear 186 to engage the gear 184.

When the toner cartridge 52 moves further in the mounting direction F, the toner cartridge 52 is pushed by the protrusion 164, so that the cartridge shutter 162 moves relative to the housing section 190 in the dismounting direction G.

Figure 1C:
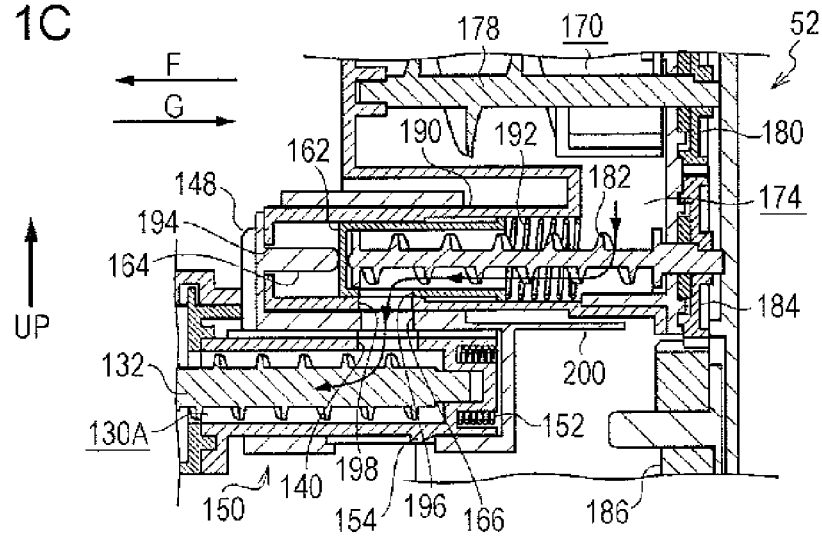
Figure 2B:
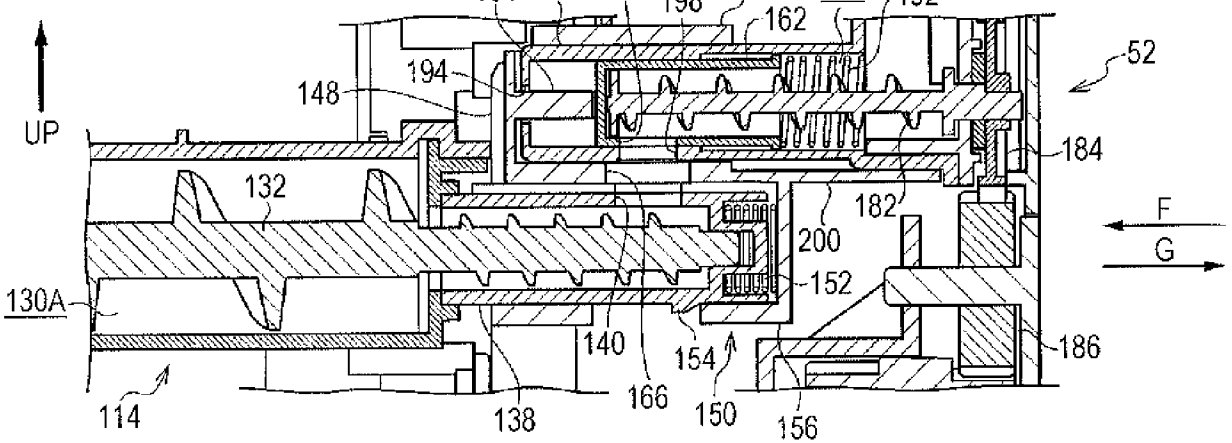

When the toner cartridge 52 is moved in the mounting direction F until the mounting of the toner cartridge 52 is completed, as shown in FIGS. 1C, 2B, and 4, the opening 196 of the cartridge shutter 162 and the opening 198 of the housing section 190 overlap each other.

The opening 198 of the housing section 190 moves above the opening 140 of the protrusion 138, as a result of which the openings 140, 166, 198, and 196 all overlap each other in the up-down direction. This completes the mounting of the toner cartridge 52.

By completing the mounting of the toner cartridge 52, the upper end portion of the gear 186 and the gear 184 engage each other, thereby making it possible for power to be transmitted between the gears 186 and 184.

By unlocking the interlock and rotating the gear 186 by a motor (not shown), the gear 180 and the gear 184, provided at the toner cartridge 52, are rotated, thereby rotating the stirring transport member 182 and the stirring member 178. By rotating the stirring transport chamber 182 and the stirring member 178, toner contained in the toner containing chamber 170 of the toner cartridge 52 is stirred. Then, the toner supplied to the toner delivery chamber 174 is stirred and transported, and moves through the openings 140, 166, 198, and 196 that overlap each other, falls into the protrusion 138, and is supplied into the developing section 114.

The toner cartridge 52 is dismounted from the apparatus body 50A by performing the aforementioned steps in the reverse order.

As described above, when the toner cartridge 52 is dismounted from the apparatus body 50A, the covering section 200 covers at least a portion of the gear 186, so that contact of foreign material (such as toner, dust, or a finger) on the gear 186 is restricted.

By restricting contact between the gear 186 and the foreign material, it is possible to reduce breakage of the gear 186.

When the toner cartridge 52 is dismounted from the apparatus body 50A, by covering the upper side of the gear 186 with the covering section 200, falling of the foreign material (such as toner or dust) around the gear 186 is restricted.

By restricting the falling of the foreign material, such as toner, around the gear 186, staining the of the gear 186 resulting from the toner flying onto the gear 186 is restricted.

By restricting the falling of the foreign material, such as toner, around the gear 186, it is possible to mitigate the problem of rotational resistance of the gear 186 being increased when the foreign material, such as toner, adheres to the rotary shaft of the gear 186.

By biasing the developing-section shutter 150 in the dismounting direction using the biasing force of the coil spring 152, the biasing force of the coil spring 152 causes the gear 186 to be covered with the covering section 200.

Since the covering section 200 is integrated to the developing-section shutter 150, the number of component parts is reduced. In addition, since coil springs need not be provided for the respective parts, the number of coil springs is reduced.

Although the present invention is described in detail by referring to specific exemplary embodiments, it is obvious to those skilled in the art that various other exemplary embodiments are possible within the scope of the present invention. For example, although, in the above-described exemplary embodiment, the gear 186 of the apparatus body 50A is rotated by a motor to transmit a driving power thereof to the gear 184 of the toner cartridge 52, it is possible to rotate the gear of the toner cartridge by a motor to transmit the driving power thereof to the gear of the image forming apparatus body.

In the exemplary embodiment, the biasing force of the coil spring 192 that biases the cartridge shutter 162 is stronger than the biasing force of the coil spring 152 that biases the developing-section shutter 150. Therefore, when the toner cartridge 52 is mounted, the developing-section shutter 150 is moved first, to cause the openings 140 and 160 to overlap each other. However, the present invention is not particularly limited thereto. The biasing force of the coil spring 192 and the biasing force of the coil spring 152 may be determined so that the openings 140, 160, 198, and 196 overlap each other substantially simultaneously.

Although, in the exemplary embodiment, the mounting structure of the removable member is described by taking as an example the case in which the toner cartridge 52 is mounted to and dismounted from the apparatus body 50A, the present invention may be applied to an image forming apparatus body and a waste toner box that is connected to the image forming apparatus body at a waste toner supplying connecting section, and the waste toner box may be dismounted, to cover the gear of the body with the covering section.

Although, in the exemplary embodiment, the mounting structure of the removable member is described by taking as an example the case in which the toner cartridge 52 is mounted to and dismounted from the apparatus body 50A, the present invention may be applied to an image forming apparatus body and a removable image carrying member or an image forming unit including the image carrying member. In this case, the covering member that covers the gear of the apparatus body may be integrated to a power-supply-member cover that covers a power supply section.

Although, in the exemplary embodiment, the mounting structure of the removable member is described by taking as an example the case in which the toner cartridge 52 is mounted to and dismounted from the apparatus body 50A, the present invention may be applied to a removable fixing device and an image forming apparatus body. In this case, the covering member that covers the gear of the apparatus body may be integrated to a power-supply-member cover that covers a power supply section.

What is claimed is:

1. A mounting structure of a removable member, comprising:

a body;

a removable member that is mounted to and dismounted from the body;

a functional member provided at the removable member, the functional member having a determined function;

a first gear provided at the removable member, the first gear transmitting power to the functional member;

a second gear provided at the body, the second gear engaging the first gear and transmitting the power to the first gear when the removable member is mounted to the body; and a covering member provided at the body, the covering member moving to an engageable position where the first gear and the second gear are engageable with each other when the removable member is mounted to the body, the covering member covering at least a portion of the second gear from an engagement side of the first gear by moving from the engageable position when the removable member is dismounted from the body.

2. The mounting structure of the removable member according to claim 1, wherein the body is provided with a biasing member that biases the covering member to a position where the covering member covers the second gear, and wherein, as the removable member is mounted to the body, the covering member is pushed by the removable member and moves against a biasing force of the biasing member, so that the second gear and the first gear are engageable with each other.

3. The mounting structure of the removable member according to claim 1, wherein the removable member includes a toner containing member that contains toner in an interior thereof, and wherein the body is an image forming apparatus body that is supplied with the toner contained in the toner containing member and that forms a toner image on a recording medium.

4. The mounting structure of the removable member according to claim 3, wherein the image forming apparatus body has a receiving opening that receives the toner contained in the toner containing member, wherein an opening-closing member that opens the receiving opening when the toner containing member is mounted to the image forming apparatus body, and that closes the receiving opening when the toner containing member is dismounted from the image forming apparatus body is provided, and wherein the covering member is integrated to the opening-closing member.

5. The mounting structure of the removable member according to claim 4, wherein the covering member covers at least a portion of an upper side of the second gear, wherein the toner containing member has a discharge opening that discharges the toner contained in the interior thereof to the receiving opening, and wherein the discharge opening is disposed above the second gear while the toner containing member is mounted to the image forming apparatus body.

6. An image forming apparatus comprising:

the removable member provided at the mounting structure of the removable member according to claim 1; and an image forming apparatus body that is a body provided at the mounting structure of the removable member according to claim 1, the image forming apparatus body capable of forming a toner image on a recording medium when the removable member is mounted.

* * * * *